US007121030B2

(12) United States Patent
Schneider

(10) Patent No.: US 7,121,030 B2
(45) Date of Patent: Oct. 17, 2006

(54) PICTURE FRAMING SYSTEM

(76) Inventor: Cynthia Schneider, P.O. Box 860, Sun Valley, ID (US) 83353

( * ) Notice: Subject to any disclaimer, the term of this patent is extended or adjusted under 35 U.S.C. 154(b) by 0 days.

(21) Appl. No.: 10/685,165

(22) Filed: Oct. 14, 2003

(65) Prior Publication Data

US 2004/0074127 A1 Apr. 22, 2004

Related U.S. Application Data

(63) Continuation of application No. 09/822,811, filed on Mar. 22, 2001, now abandoned, which is a continuation-in-part of application No. 09/537,860, filed on Mar. 28, 2000, now abandoned, which is a continuation-in-part of application No. 09/007,491, filed on Jan. 15, 1998, now Pat. No. 6,065,236, which is a continuation-in-part of application No. 08/880,021, filed on Jun. 20, 1997, now abandoned.

(51) Int. Cl.
*G09F 3/18* (2006.01)

(52) U.S. Cl. ..... 40/661; 40/658

(58) Field of Classification Search ..... 40/757, 40/776, 657, 658, 661
See application file for complete search history.

(56) References Cited

U.S. PATENT DOCUMENTS

| | | | |
|---|---|---|---|
| 2,592,386 | A | 4/1952 | Breakey |
| 3,525,493 | A | 8/1970 | Chrietzberg et al. |
| 3,606,507 | A | 9/1971 | Williams, Jr. |
| 4,098,014 | A | 7/1978 | Lauer et al. |
| 4,250,640 | A | 2/1981 | Culhane |
| 4,629,075 | A | 12/1986 | Hutten |
| 4,821,437 | A | 4/1989 | Abramson et al. |
| 5,467,949 | A | 11/1995 | Lemke |
| 6,026,603 | A | 2/2000 | Kump et al. |
| 6,065,236 | A | 5/2000 | Schneider |

*Primary Examiner*—Joanne Silbermann
(74) *Attorney, Agent, or Firm*—Perkins Coie LLP

(57) ABSTRACT

A framing system for mounting photographs, artwork, documents, etc. on a flat surface, such as a wall includes a molding or wall strip and an envelope having a clear front panel, with the envelope slidably engageable into the molding strip. The molding strip includes a slot, and the envelope includes an upper edge having a configuration matching the slot. The object to be displayed is placed into the envelope, and then the envelope slides into engagement with the molding strip.

10 Claims, 15 Drawing Sheets

PICTURE FRAMING SYSTEM

This application is a Continuation of Ser. No. 09/822,811, filed Mar. 22, 2001, and now abandoned, which is a continuation-in-part of Ser. No. 09/537,860, filed Mar. 28, 2000, and now abandoned, which in turn is a continuation-in-part of Ser. No. 09/007,491, filed Jan. 15, 1998, now U.S. Pat. No. 6,065,236, which in turn is a continuation-in-part of Ser. No. 08/880,021, filed Jun. 20, 1997, and now abandoned. These applications are incorporated herein by reference.

FIELD OF THE INVENTION

The field of the invention is frames and mountings for photographs, artwork, documents, etc.

BACKGROUND OF THE INVENTION

Various picture frames have been used in the past to mount and display photographs, artwork, documents, and other relatively flat objects on a wall or other surface. Traditional picture frames typically have four sides or edges, with a separate plastic or glass cover plate over the displayed photograph or other object. While these types of picture frames may have satisfied various needs, they generally do not provide for quickly changing the displayed photograph. In addition, they may be relatively costly due to the materials and labor necessary to manufacture them. Accordingly, there is a need for an improved framing system for mounting and displaying photographs, artwork, documents, etc.

SUMMARY OF THE INVENTION

To these ends, a picture framing system includes a mounting strip which may be mounted on a wall. The mounting strip preferably has a slot running through it. An envelope or frame is advantageously clamped into the mounting strip. The envelope is configured to hold and display a flat object. Other and further objects and advantages will appear hereinafter.

BRIEF DESCRIPTION OF THE DRAWINGS

In the drawings, wherein similar reference characters denote similar elements throughout the several views.

Figure 7:
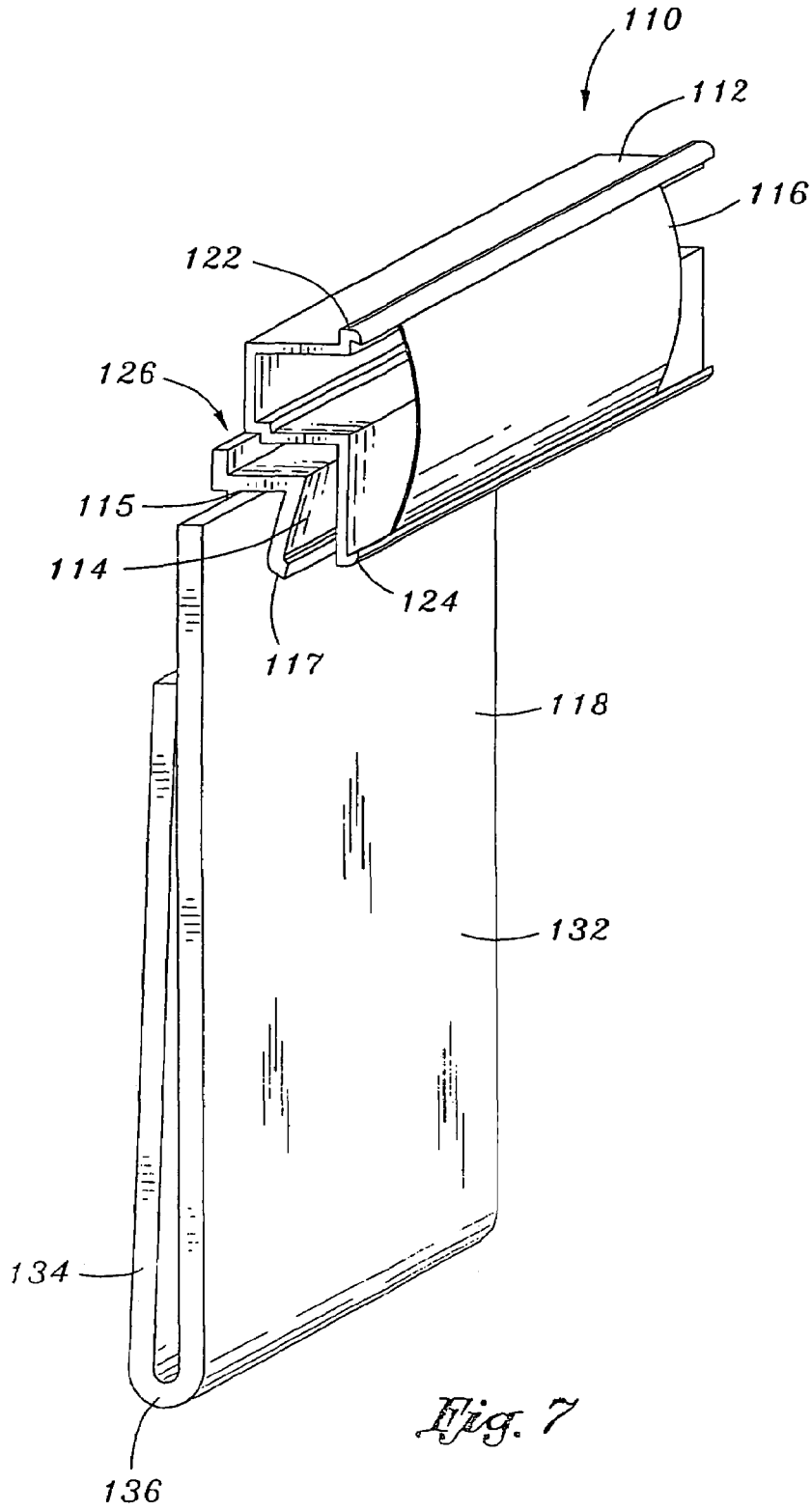
FIG. 7 is a left side perspective view of a third embodiment of the invention.
Figure 12:
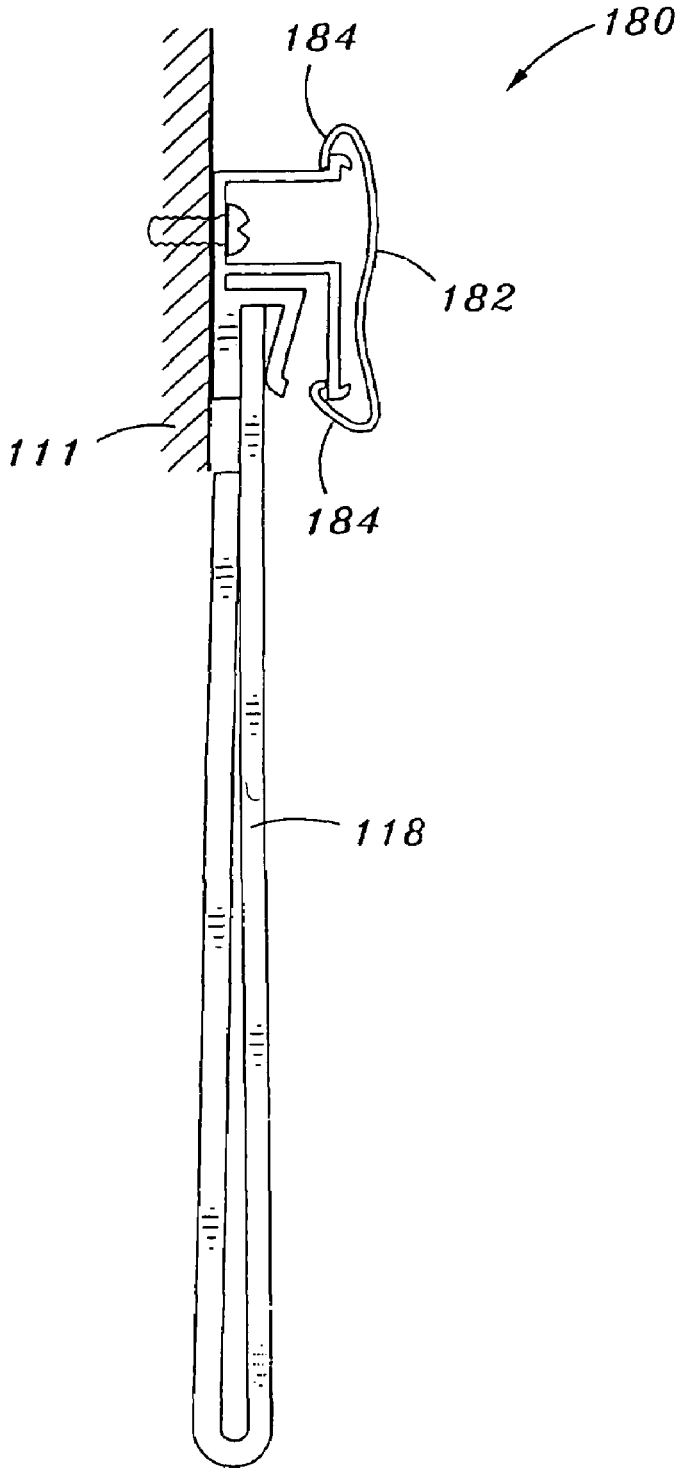
Figure 13:
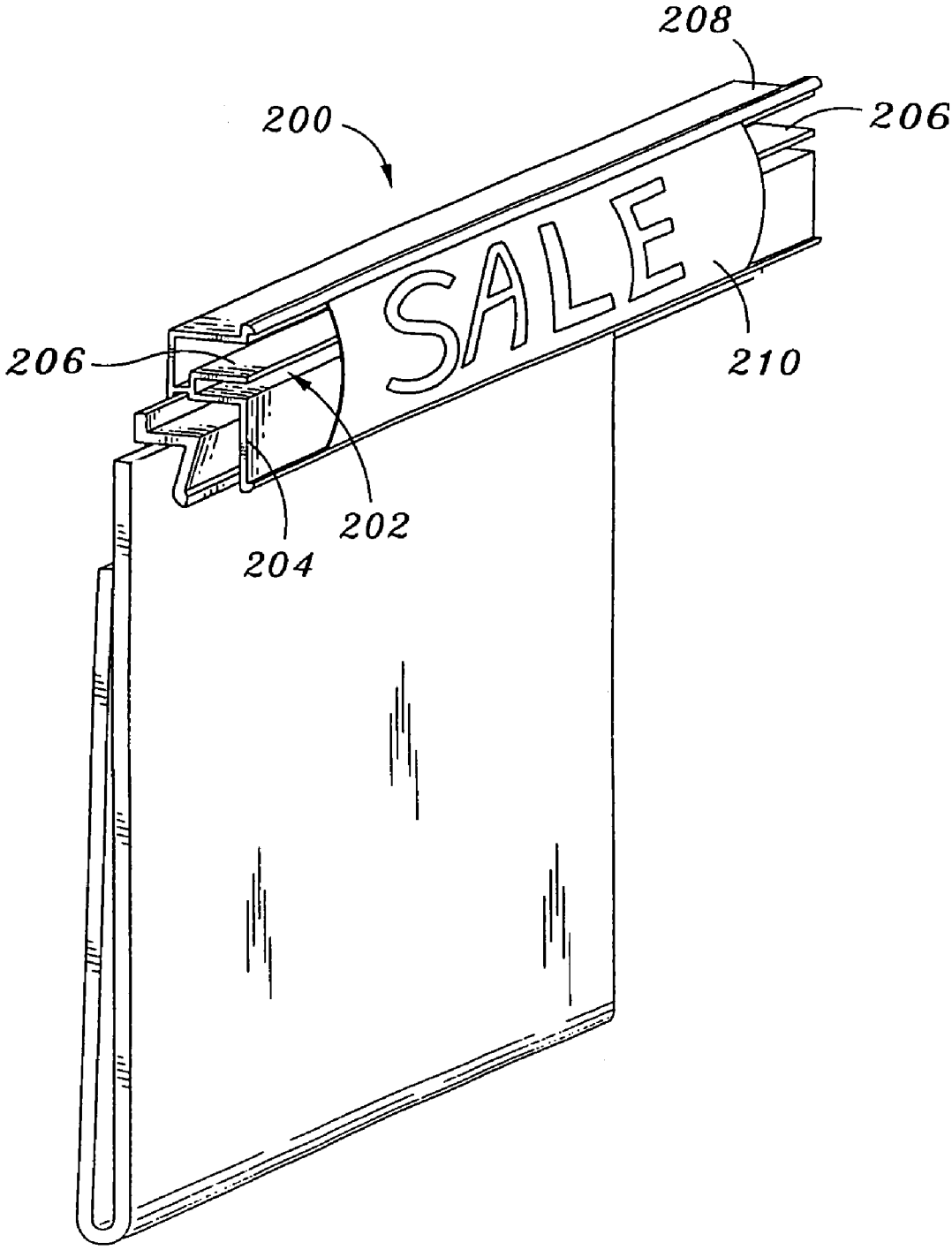
Figure 14:
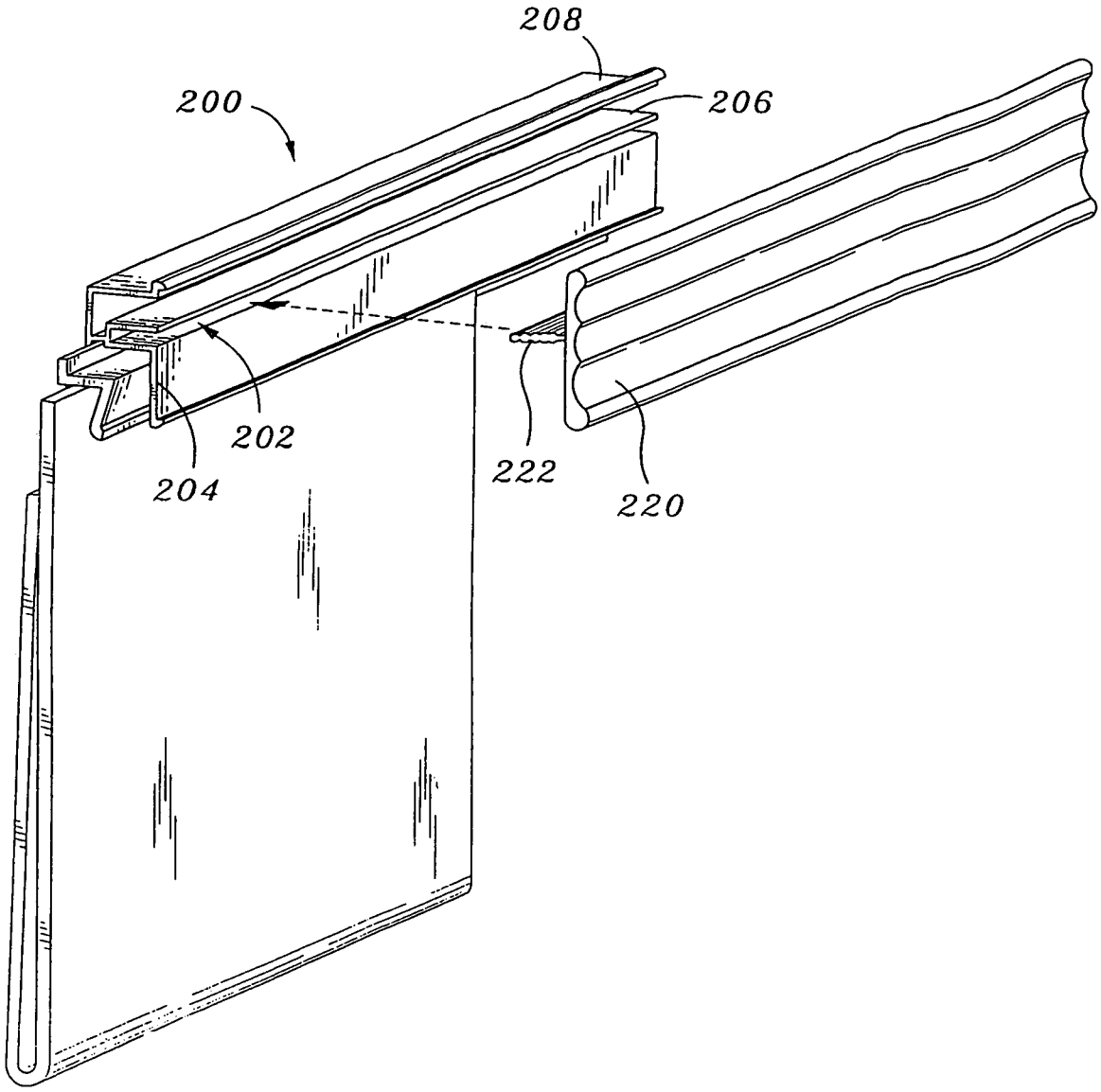
Figure 15:
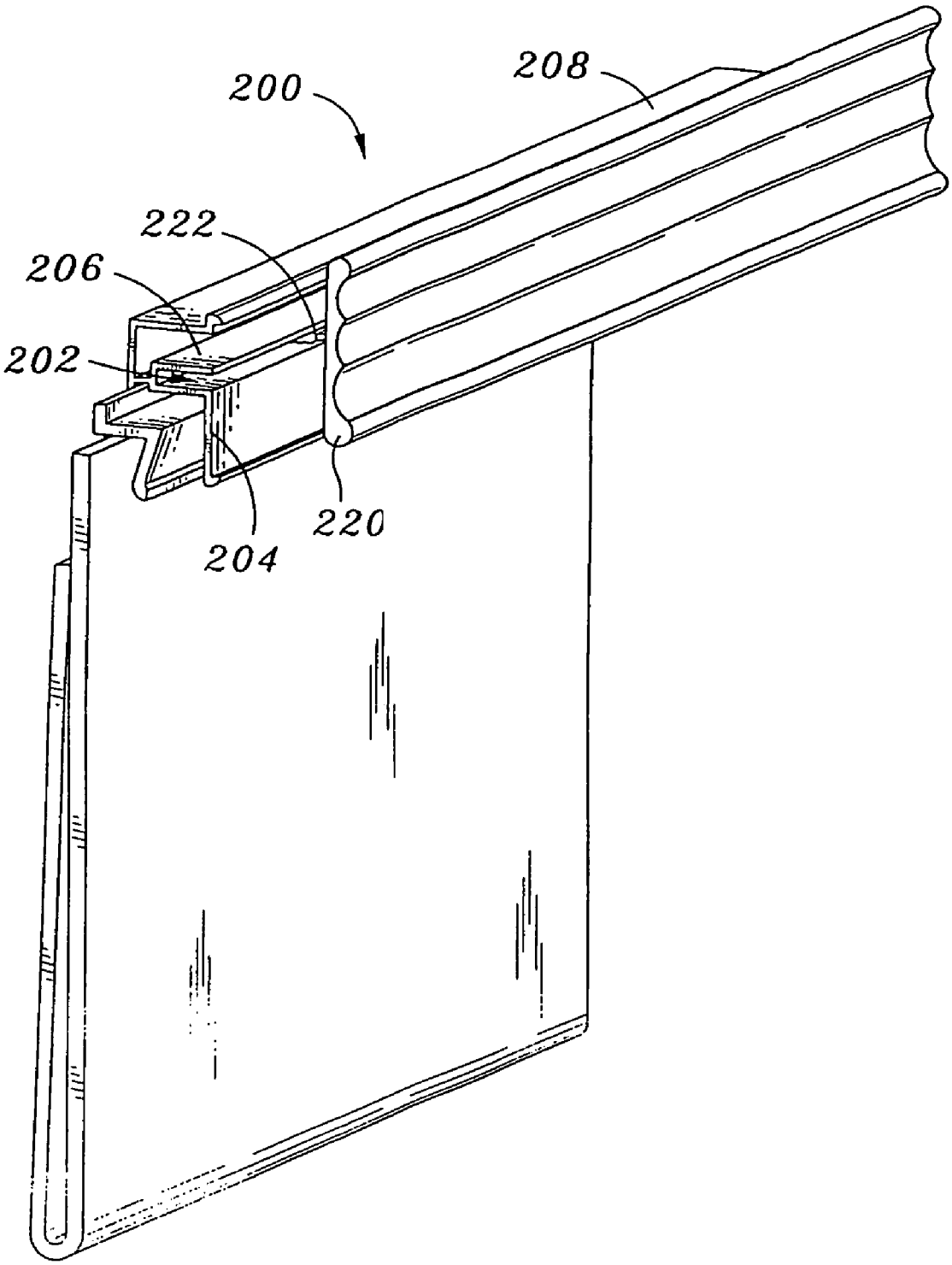
Figure 16:
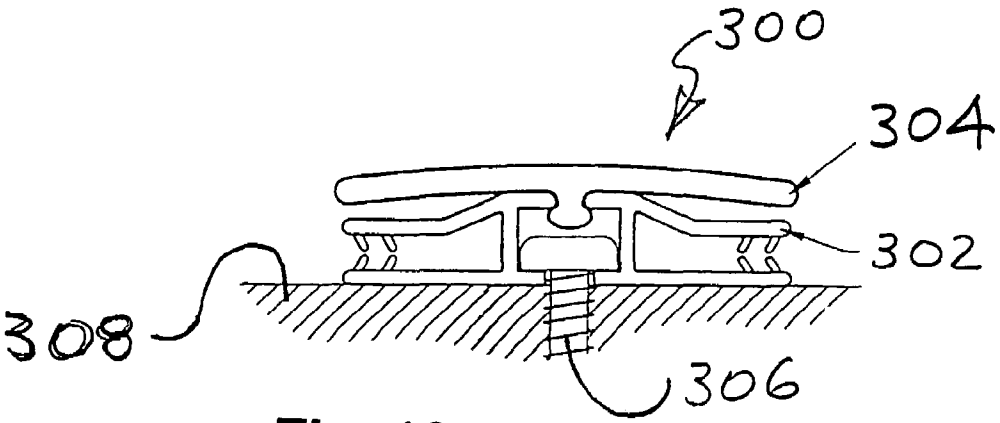
Figure 17:
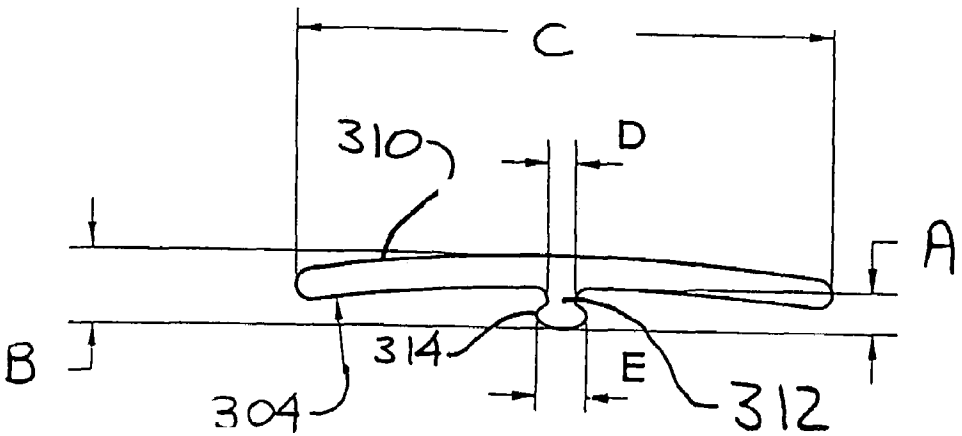
Figure 18:
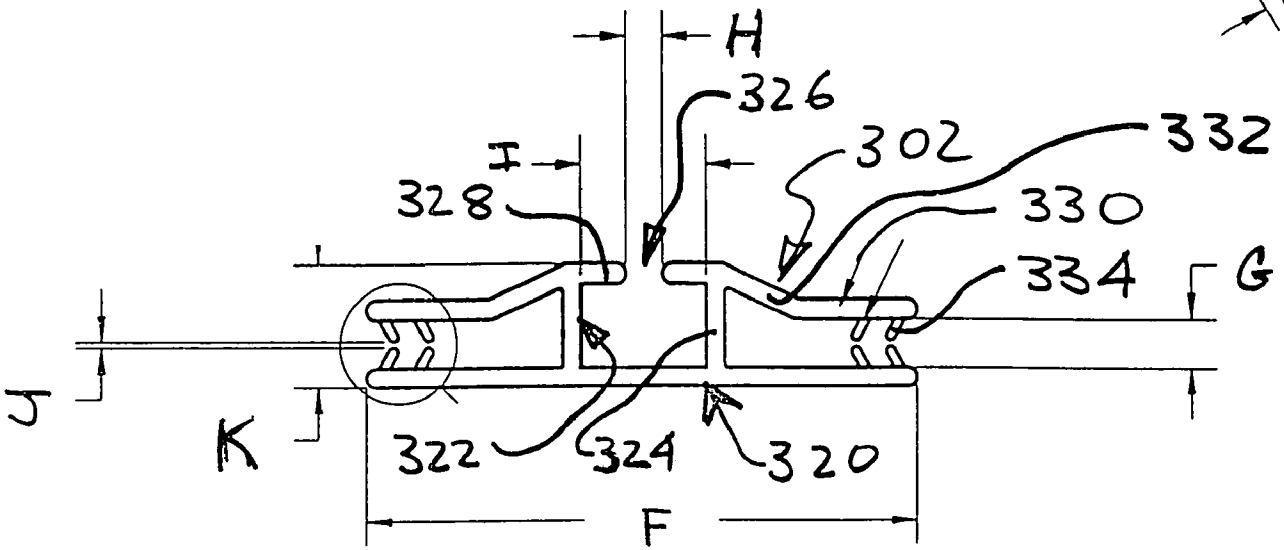

Fig; 11 is a rear perspective view of an alternative frame;

FIG. 12 is an alternative embodiment similar to the embodiment of FIG. 7 but having a larger cover strip;

FIG. 13 is a perspective view of another embodiment having a mounting which can support alternate cover designs;

FIG. 14 is a perspective view thereof showing installation of an alternative cover;

FIG. 15 is a perspective view thereof showing the cover installed;

FIG. 16 is a side view of another embodiment;

FIG. 17 is a side view of the cover strip shown in FIG. 16;

FIG. 18 is a side view of the mounting strip shown in FIG. 16; and

Figure 19:
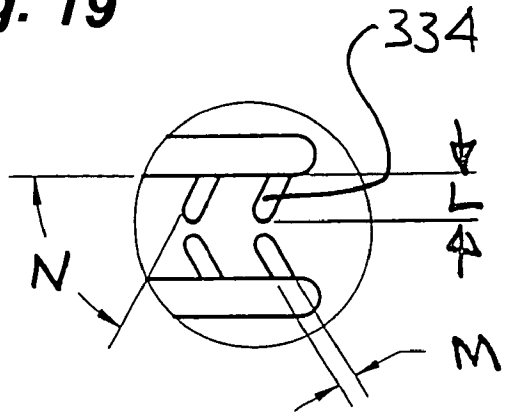

FIG. 19 is an enlarged detail of the mounting strip shown in FIG. 18.

Figure 20:
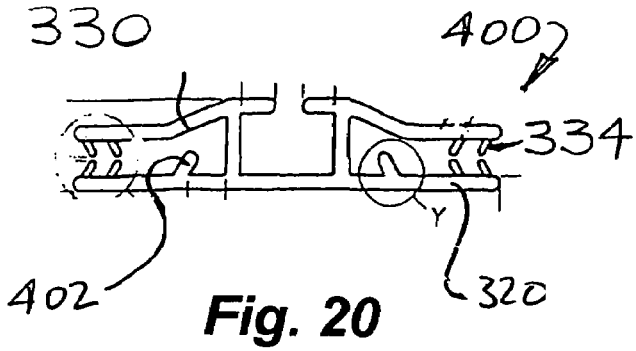

FIG. 20 is a side view of an alternative embodiment of the mounting strip shown in FIG. 18.

Figure 21:
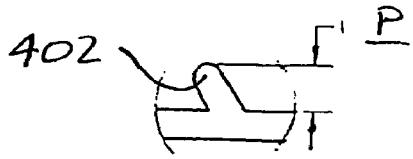

FIG. 21 is an enlarged detail of the protrusion shown in FIG. 20.

Figure 22:
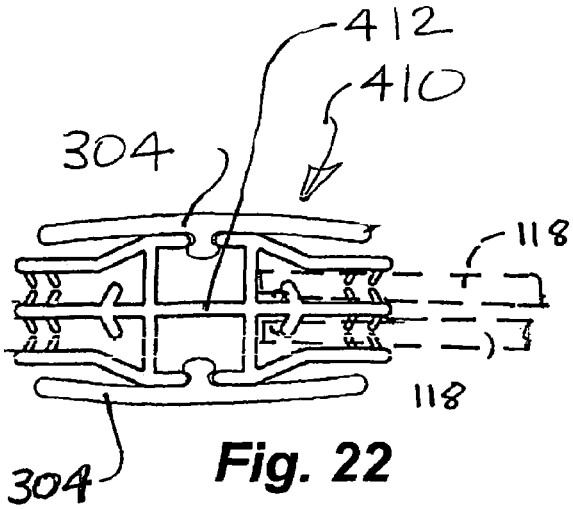

FIG. 22 is an alternative embodiment of the design shown in FIG. 20, for holding front, back, top and bottom frames.

Figure 23:
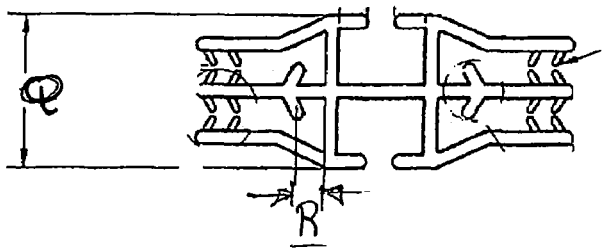

FIG. 23 is a side view of the mounting strip shown in FIG. 22 without the cover strip.

DETAILED DESCRIPTION OF THE PREFERRED EMBODIMENT

Figure 1:
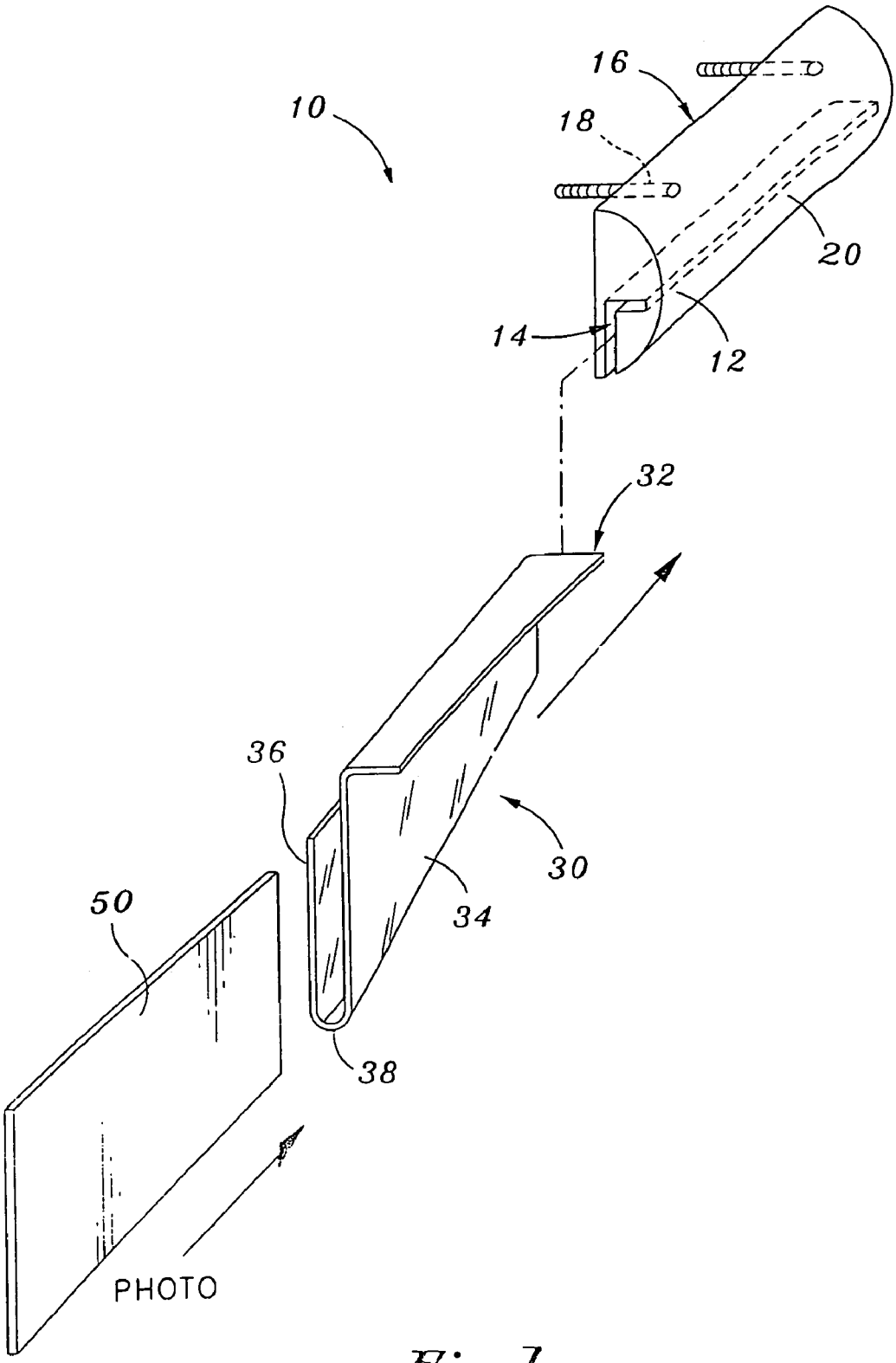
FIG. 1 is an exploded perspective view of a preferred embodiment of the present framing system.

Turning now in detail to the drawings, as shown in FIG. 1, the present framing system preferably includes a mounting strip 12, and an envelope 30 for holding an object to be displayed, such as a photograph 50. The mounting strip 12 may be made of any solid material, such as metal, wood, or plastic, which can be mounted horizontally or vertically on a wall.

Figure 3:
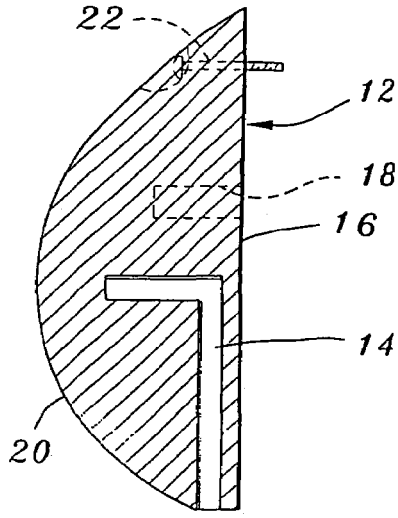
FIG. 3 is a section view of the mounting strip shown in FIG. 1.
Figure 4:
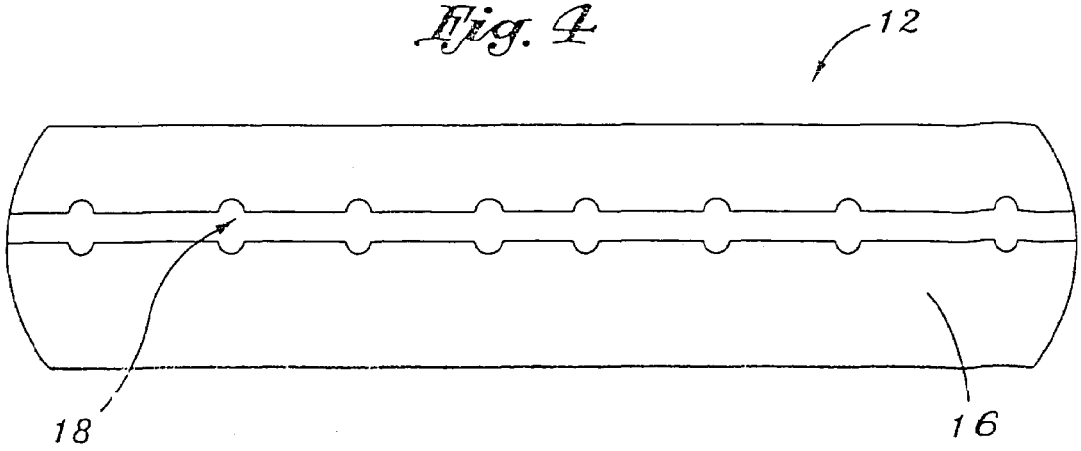
FIG. 4 is a elevation view of the rear surface of the mounting strip shown in FIG. 3.

Referring to FIGS. 1 and 3, the mounting strip 12 includes an interior slot or groove 14 which preferably runs for the entire length of the strip 12. As shown in FIG. 3, blind holes 18 preferably extend into the flat back surface 16 of the mounting strip 12, so that the mounting strip 12 can be mounted on nails, screws, or other fasteners extending out of a wall. As shown in FIG. 4, the blind holes 18 are preferably equally spaced apart along the flat back surface 16. The mounting strip 12 preferably has a contoured front surface 20, which may be configured to provide an aesthetic appearance.

Figure 2:
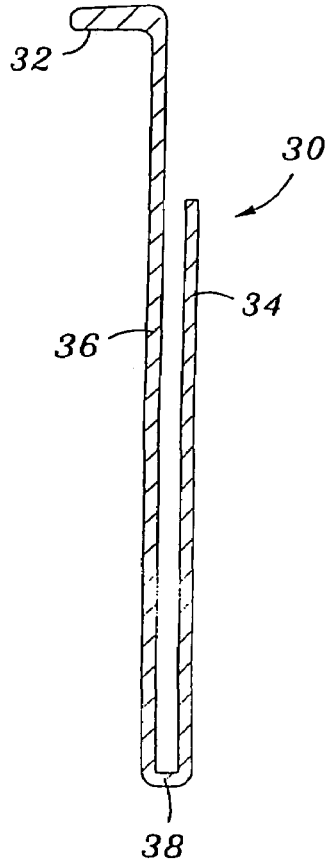
FIG. 2 is a section view of the envelope or frame shown in FIG. 1.
Figure 6:
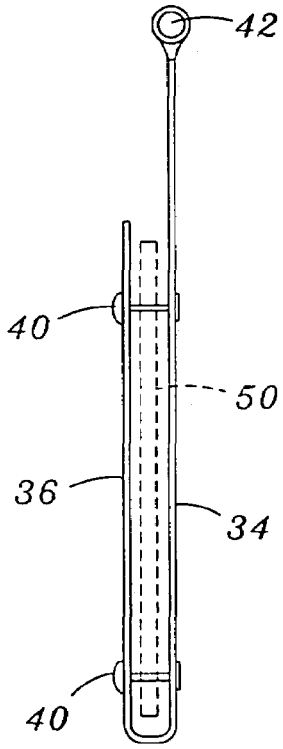
FIG. 6 is a section view of an alternative preferred embodiment of the envelope or frame.

Referring to FIGS. 1 and 2, the envelope 30 is advantageously made of a clear plastic material, such as Plexiglass. A tab 32 is provided at the top of the envelope 30. The tab 32 is configured to slide into the slot 14 in the amounting strip 12. As shown in FIG. 1, the tab 32 and slot 14 may be L-shaped. Alternatively, as shown in FIG. 6, the tab 32 may be cylindrical and slidably engage a corresponding cylindrical slot 14 in the mounting strip 12. The slot 14 and tab 32 can of course have various other shapes as well. As shown in FIG. 2, the clear envelope 30 has a front panel 34 joined to a back panel 36 via an elbow section 38. The front panel 34 is taller than the rear panel 36, so that when the envelope 30 is slidably engaged into the mounting strip 12, the rear panel 36 does not extend up between the mounting strip 12 and the wall.

Figure 5:
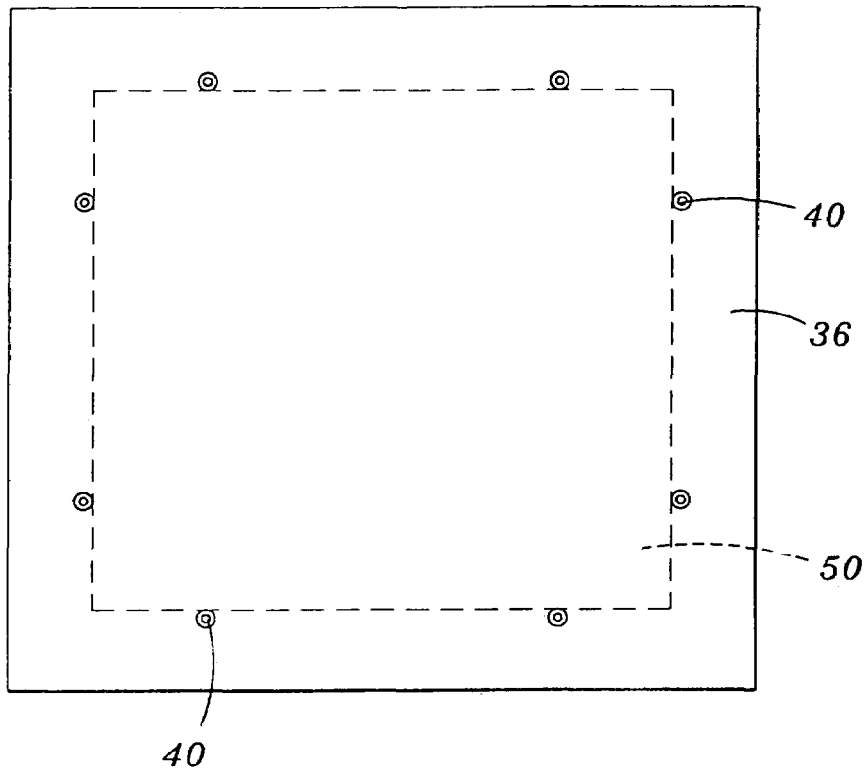
FIG. 5 is an elevation view of the back of the envelope shown in FIG. 2.

As best shown in FIGS. 5 and 6, pins 40 extend through the back panel 36 towards the front panel 34, to support the object 50 within the envelope 30. FIG. 5 shows a preferred pattern for the pins 40, although various patterns may be used, depending on the nature of the object 50 displayed, and the orientation (vertical, horizontal, diagonal, etc.) of the mounting strip 12 and envelope 30 on-the wall, relative to the direction of the force of gravity. The pins 40 are held in place by a friction fit as they are pressed through the holes in the back panel 36. The length of the pins 40 is preferably selected so that, when fully installed, the front end of the pin just lightly touches the front panel 34.

The mounting strip 12 may be provided in different lengths, so that one or more envelopes 30 can be held in a single mounting strip 12. If a single envelope 30 is used, the mounting strip 12 is preferably cut to the same length as the envelope 30. The mounting strip 12 and envelope 30 may be provided in pre-cut lengths, or in extended lengths which may be cut to fit any particular object 50. If the mounting strip 12 and envelope 30 are manufactured with uniform cross sections, they may be economically extruded.

In use, the mounting strip 12 may be positioned on a wall on top of the object 50, or to one side of the object 50. In addition, if the pins 40 are used, the mounting strip 12 may even be positioned underneath the object 50.

To mount the mounting strip 12 on a wall, nails or other fasteners are driven into the wall, at spacings matching the blind holes 18 on the mounting strip. The mounting strip can then be placed over the fasteners extending out of the wall, as shown in FIG. 1, to hang the mounting strip 12 on the wall.

The pins 40 may also be made of a clear material, so that they are less visible. The pins 40 also hold the object 50 in place in the envelope 30, when the envelope 30 and mounting strip 12 are mounted vertically on the wall.

Figure 8:
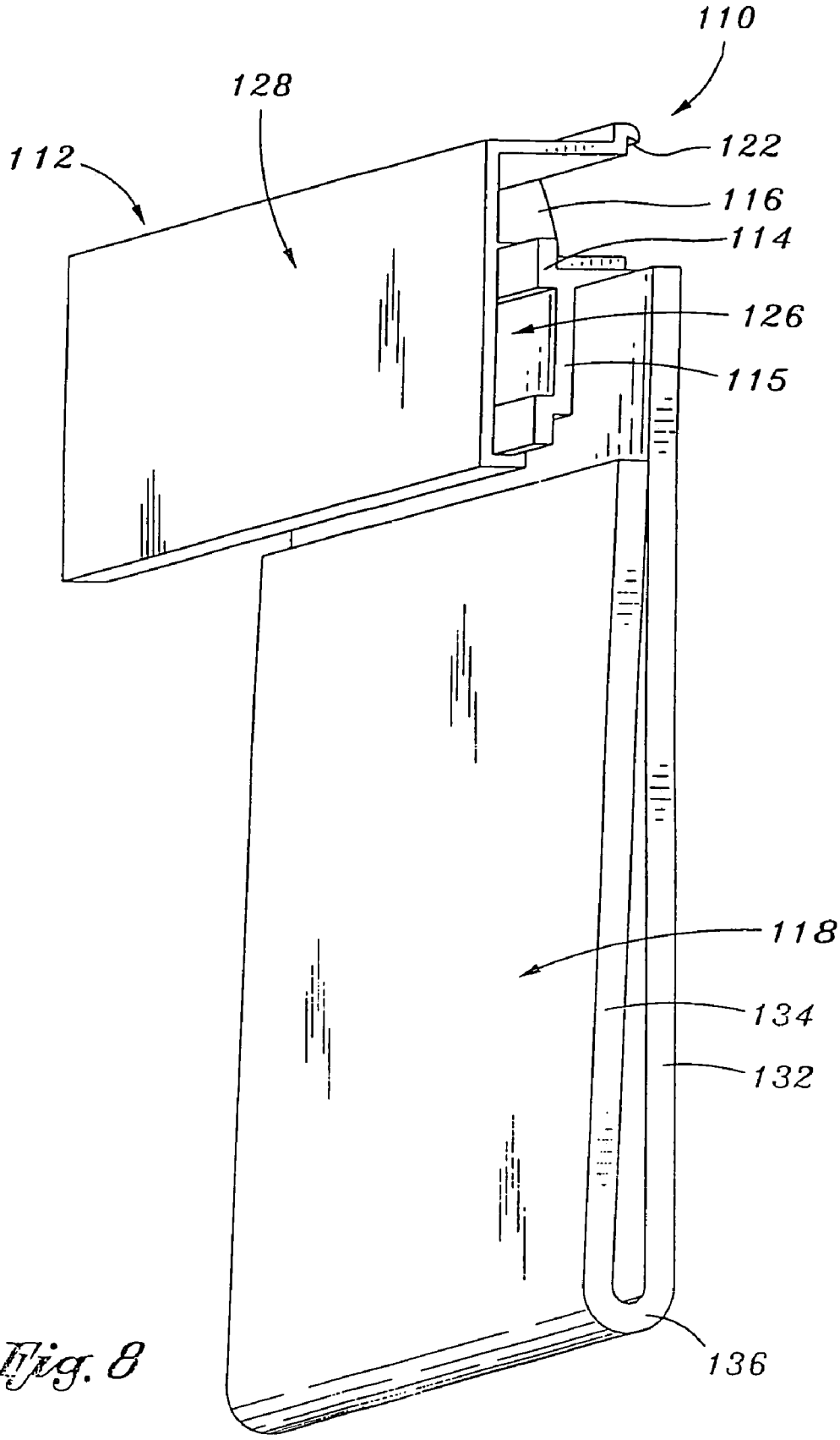
FIG. 8 is a right side perspective view thereof.

Turning now to FIG. 7, in a third embodiment 110, a molding strip 112 has an upper lip 122 and a lower lip 124, as well as a flat rear surface 128, as shown in FIG. 8. A cover 116 is snapped fit between the upper lip 122 and the lower lip 124. Alternatively, the cover 116 may be slid into the molding strip 112 from either end. A grip strip slot 126 is formed in the molding strip 112 and holds a grip strip 114. The grip strip 114 holds a frame or envelope 118. The frame 118 is preferably a transparent material and has a front surface including an extended upper edge 135, and a rear surface 134 joined via a U-bend 136.

The molding strip 112 is preferably an aluminum or plastic extrusion of varying length, for example, from an inch or two up to 30 feet or more. The molding strip 112 is designed to contain the grip strip 114 and the cover or trim strip 116. The flat rear surface 128 of the molding strip 112 is provided to attach to a wall or, shelf edge by fasteners or adhesives. The lips 122 and 124 on the front surface of the molding strip 112 provide a way to attach a decorative cover 116.

In use, a flat photograph, artwork or other thin media is placed within the frame 118. The photograph may be slid into the frame 118.from one side. Alternatively, the front surface 132 may be pulled apart slightly from the rear surface 34 to allow placement of the photograph, with the upper edges of the front and rear surfaces subsequently moving back together via the resiliency of the material of the frame 118. Using light force, the frame 118 is then pushed into the grip strip 114. The legs 115 and 117 of the grip strip 114 move apart slightly as the upper edge of the front surface 32 is pushed between them. The legs 115 and 117 then exert a compressive force on the frame 118 to hold it in place. The frame 118 may be inserted into the grip strip 114 at any position along its entire length. The molding strip 112 may be mounted in various orientations to provide versatile photograph display possibilities. The frame system may be used to display fine art in retail stores, etc.

Figure 9:
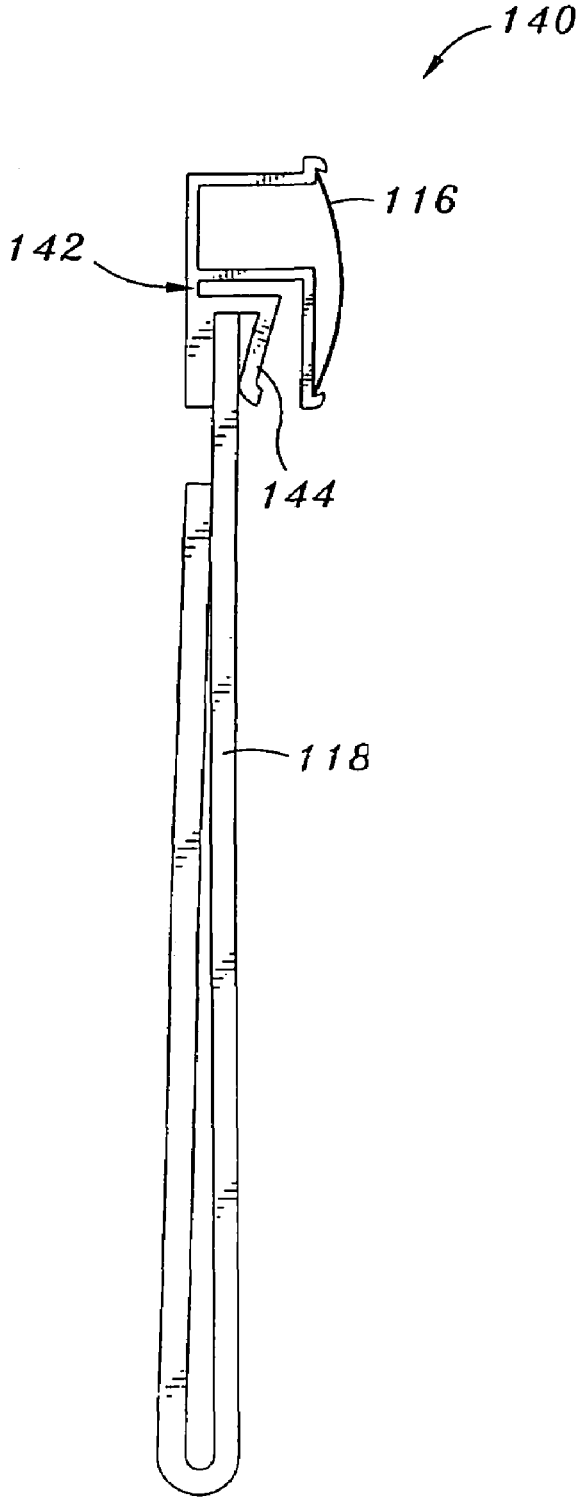
FIG. 9 is a side elevation view of a fourth embodiment.

Turning now to FIG. 9, in a fourth embodiment 140, a molding strip 142 includes a grip lip 144, to hold the frame 118. In this embodiment 140, a separate grip strip 114 is not used. The frame is held via the gripping action achieved via material deflection and surface friction.

Figure 10:
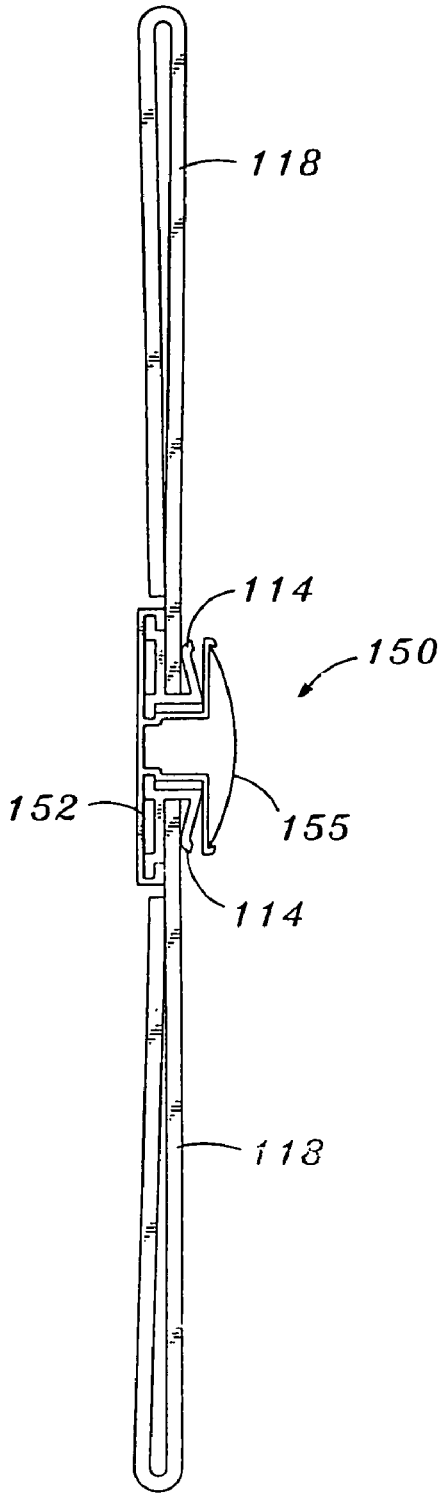
FIG. 10 is a side elevation view of a fifth embodiment.

Turning to FIG. 10, in a fifth embodiment 150, a double sided molding strip 152 is provided with mirror image grip strip slots 126 and grip strips 114, to hold frames 118 side by side or top and bottom, or at angles. A wider cover strip 155 may be provided.

Figure 11:
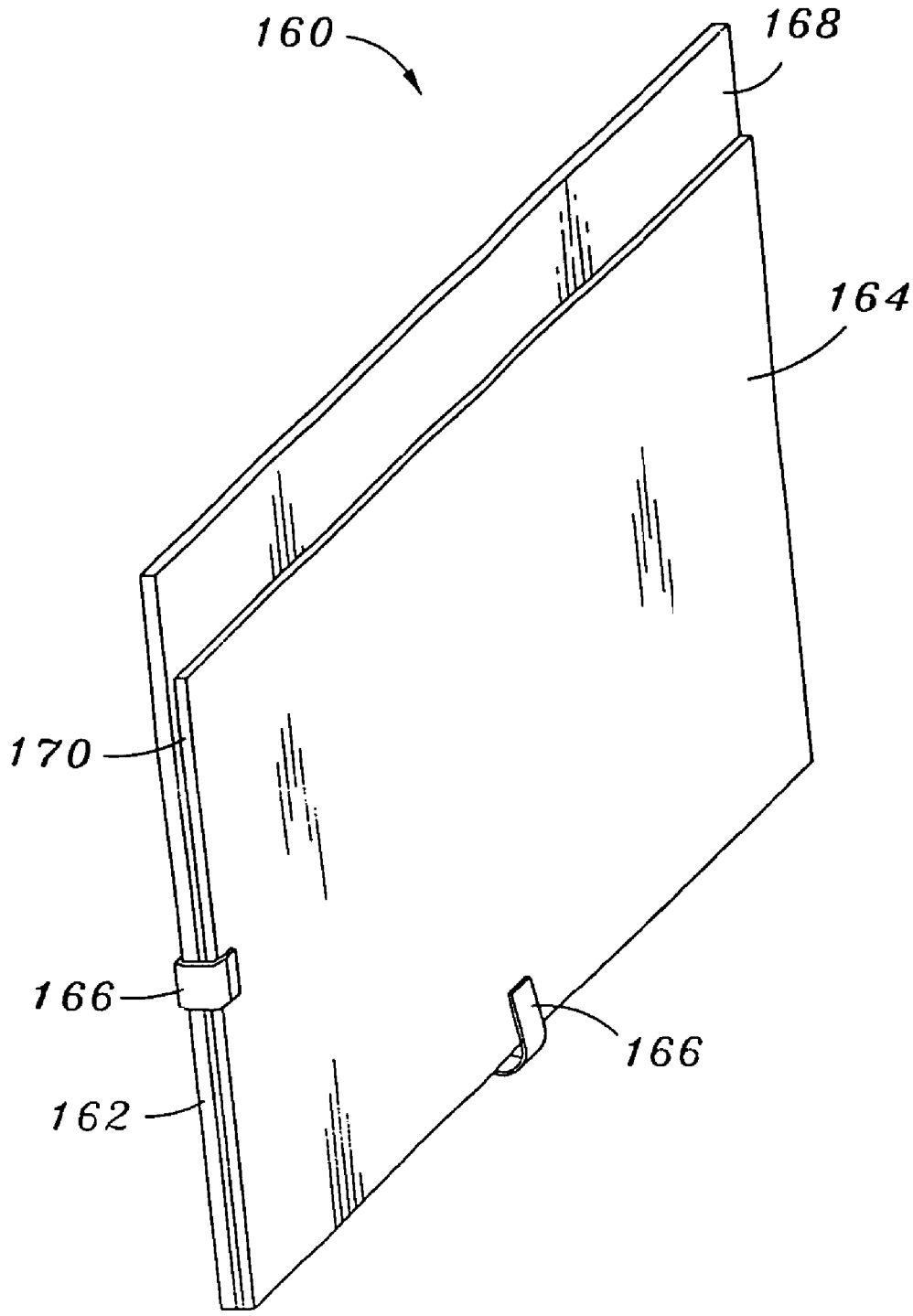

FIG. 11 shows a frame 160 having a separate front panel 162 and a separate rear panel 164 held together with clips 166. The front and rear panels may be glass. The object to be displayed is contained within the two panels. The upper edge 168 of the front panel 62 is pushed into the grip strip 114, to support the frame 160 onto the molding strip 112 or 142. The clips 166 are removable by hand or with tools, to allow the photograph or other artwork to be placed and removed from the frame 60.

FIG. 12 shows another embodiment 180 similar to the embodiment 110 shown in FIG. 7 but including a larger cover strip 182 having snap lips 184 extending over and around the lips 22 and 24.

The decorative cover 116 or 182 conceals the mounting hardware 150 which is preferably installed through the front surface. The decorative cover may be plastic, thin metal or a wood veneer. Numbers and/or letters may be provided on the cover or separately snapped or slid in between the lips 122 and 124, to identify or provide other information about the photograph or other object displayed.

Various fasteners 151 can be installed through clearance holes in the molding strip 112 to attach the molding strip 112 to a wall 111 or other surface.

As shown in FIGS. 13–15, a modified strip 200 is similar to the strip 112 shown in FIG. 8 and further includes a slot 202 formed between a lower L-shaped leg 204 and a center plate 206. The center plate 206 is between a top plate 208 of the molding strip 200 and the L-shaped leg 204. The front edges of the L-shaped leg 202 and the top plate 208 have lips for holding a flexible cover 210 as shown in FIG. 13. Alternatively, as shown in FIGS. 14 and 15, a cover 220 may be attached by inserting a tap 222 into the slot 202, with the center plate 206 and L-shaped leg 204 clamping the tab in place.

Turning to FIGS. 16–19, in another alternative embodiment, a cover strip is 304 is held onto a grip strip 302. Fasteners 306 hold the grip strip 302 into a wall, door, etc., 308. As shown in FIG. 17, the cover strip 304 has an outer convex surface 310, and a center rib or rail 312 having rounded sides 314.

As shown in FIG. 18, the grip strip 302 has a base 320 and a center channel 322 formed by channel walls 324 extending outwardly from the base 320. A rail slot 326 is formed between lips 328 on the channel walls 324, extending towards each other. Grip arms 330 attached to the center channel walls 322 extend away from each other. The grip arms 330 have a joggle section 332. As shown in FIG. 19, fingers 334 on the grip arms 330 and base 320 are generally aligned and extend towards each other.

Representative dimensions of the features shown in FIGS. 17–19 are:

A: 0.12;
B: 0.20;
C: 1.5;
D: 0.08;
E: 0.15;
F: 1.5;
G: 0.12;
H: 0.10;
I: 0.34;

J: 0.015;
K: 0.31;
L: 0.05;
M: 0.025;
N: 60°.

The cover strip 304 is preferably made of Acrylic, while the grip strip 302 is preferably made of Vinyl. The cover strip 304 and grip strip 302 are symmetrical about their center lines.

In use, the grip strip 302 is cut to the desired length for mounting a photograph, certificate, or other flat document or media. The grip strip 302 may be provided with clearance holes for fasteners 306. Alternatively, clearance holes can be drilled or punched by the user during installation. The grip strip 302, may also be provided with a sticky back, so that it adheres to the wall 308, avoiding the need for the fasteners 306.

With the grip strip 302 appropriately cut to a desired length, and positioned on the wall 308, fasteners 306 are pushed through in-between the lips 328, so that the head of the fastener comes to rest on top of the base 320, after the fastener is threaded into the wall 308 and seated in place. The cover strip 304 is cut to a desired length and is secured onto the grip strip 302, by pressing the center rail 312 into the rail slot 326 of the grip strip 302. The cover strip 304 has a slightly convex outer surface 310, which provides an aesthetic appearance, and conceals the fasteners 306. The surface 310 also provides a continuous and smooth area for applying labels, etc. The upper edge of an envelope, such as envelope 118, as shown in FIG. 12, is then pushed between the fingers 334. As this occurs, the fingers 334 deflect slightly, and the grip arms 330 move apart slightly. After the envelope is fully installed, preferably with the upper edge of the envelope, abutting the channel wall 324, the envelope is held in place by the resilient gripping force of the fingers 334 and arms 330. Consequently, the envelope is held in place on the wall. Two envelopes 118 can be held by the grip strip 302, similar to the design shown in FIG. 10. However, the longer side of the envelope 132 (as shown in FIG. 8) may face outwardly, or towards the wall 308, depending on the user's preference.

FIG. 20 shows a design similar to FIG. 18 in all aspects, but further including protrusions 402. The protrusions 402 preferably extend upwardly from the base 320 towards the grip arms 330 in a direction parallel to the fingers 334 adjacent to each protrusion 402. The protrusions 402 extend vertically above the base 320 by a dimension P, preferably about 0.08 inches. The protrusion 402 assists in holding the frames 118 into the strip 400.

Turning now to FIG. 22, an alternative design 410 has strips similar to the strip 400 shown in FIG. 20, in a back to back, or side by side configuration, with the two strips 400 sharing a common base 412. This design can hold up to 4 frames 118. It is therefore useful in free standing or suspended displays (in contrast to a wall mount) where the materials within the frames 118 are visible from both sides. FIG. 23 shows the strip without the cover strip 304.

The dimensions listed above in connection with FIGS. 18 and 19 apply equally as well to the embodiments shown in FIGS. 20–23. The grip arms 330 and base 320 preferably have a wall thickness of about 0.05 inches. The strips are advantageously manufactured from rigid/flex vinyl, with the fingers being flexible and the base and arms more rigid.

In FIG. 23, dimension Q is preferably about 0.57 inches and dimension R is about 0.12 inches.

Thus, while several embodiments have, been shown and described, various modifications and changes may be made without departing from the spirit and scope of the invention. The invention, therefore, should not be restricted, except by the following claims.

I claim:

1. A picture framing system comprising:

a wall strip having a first arm and a second arm;

a slot in the wall strip substantially perpendicular to the first and second arms;

a transparent envelope having a front surface and a rear surface, with the front surface connecting with the rear surface at a U-bend;

the front surface having an upper edge adapted to slide between the first and second arms; and a cover attachable to the wall strip and having a tab extendable into the slot, to attach the cover onto the wall strip.

2. The picture framing system of claim 1 with the rear surface having a upper edge spaced apart from the upper edge of the front surface, and with the upper edge of the rear surface not contacting the wall strip when the front surface is between the first and second arms.

3. The picture framing system of claim 1 wherein the rear surface of the front panel is biased into contact with the front surface of the front panel.

4. The framing system of claim 1 wherein the dimensions of the cover substantially match the dimensions of the wall strip.

5. The framing system of claim 1 wherein the front and rear surfaces of the envelope can be temporarily separated to form a gap to allow a photograph to be inserted between them.

6. The framing system of claim 1 with the wall strip wider than the envelope.

7. The framing system of claim 1 further comprising a second generally transparent envelope having an upper end and a lower end, with the upper end of the second envelope also adapted to slide between and remain held in the wall strip by the first and second arms, and with the second envelope also having a front surface connecting to a rear surface at a U-bend, at the lower end of the second envelope, and with the second envelope also having open sides.

8. The framing system of claim 1 wherein the wall strip comprises a plastic extrusion adapted to be cut to a desired length.

9. The framing system of claim 1 with the cover dimensioned so that it overlies the wall strip entirely.

10. A picture framing system comprising:

a wall strip having a first arm and a second arm;

a slot in the wall strip substantially perpendicular to the first and second arms, a transparent envelope having a front surface and a rear surface, with the front surface connecting with the rear surface at a U-bend, the front surface having an upper edge adapted to slide between the first and second arms; and a cover attachable to the wall strip and having a tab extendable into the slot, to attach the cover onto the wall strip, and with the cover dimensioned so that it overlies the wall strip entirely.

* * * * *